US005244381A

United States Patent [19]

Cahlik

[11] Patent Number: 5,244,381

[45] Date of Patent: Sep. 14, 1993

[54] $NO_x$ FLAME SPREADER FOR AN INSHOT BURNER

[75] Inventor: George W. Cahlik, Mesquite, Tex.

[73] Assignee: Lennox Industries Inc., Carrollton, Tex.

[21] Appl. No.: 861,958

[22] Filed: Apr. 2, 1992

[51] Int. Cl.[5] ..... F23M 9/06

[52] U.S. Cl. ..... 431/171; 431/347; 126/99 A; 126/116 R; 432/209; 432/222

[58] Field of Search ..... 431/347, 171, 326, 354, 431/159; 126/99 A, 99 C, 99 R, 116 R; 432/209, 222, 176, 181

[56] References Cited

U.S. PATENT DOCUMENTS

| | | | |
|---|---|---|---|
| 2,220,603 | 11/1940 | Hirtz et al. | 431/171 |
| 4,284,402 | 8/1981 | Sheets et al. | 431/347 |
| 4,629,415 | 12/1986 | Dewerth et al. | 431/347 |
| 4,701,123 | 10/1987 | Tallman et al. | 431/171 |
| 4,776,320 | 10/1988 | Ripka et al. | 431/347 |
| 5,083,917 | 1/1992 | McCullough et al. | 432/209 |

*Primary Examiner*—James C. Yeung

*Attorney, Agent, or Firm*—Allegretti & Witcoff, Ltd.

[57] ABSTRACT

A furnace includes a generally cylindrical combustion chamber that is open at one end for receiving a single port inshot target burner. The target burner includes a flame spreader for lowering the heat energy and temperature of the gas flame so as to reduce $NO_x$ emissions. The flame spreader includes a plurality of rods affixed to the target plate or disc.

8 Claims, 1 Drawing Sheet

Fig. 1
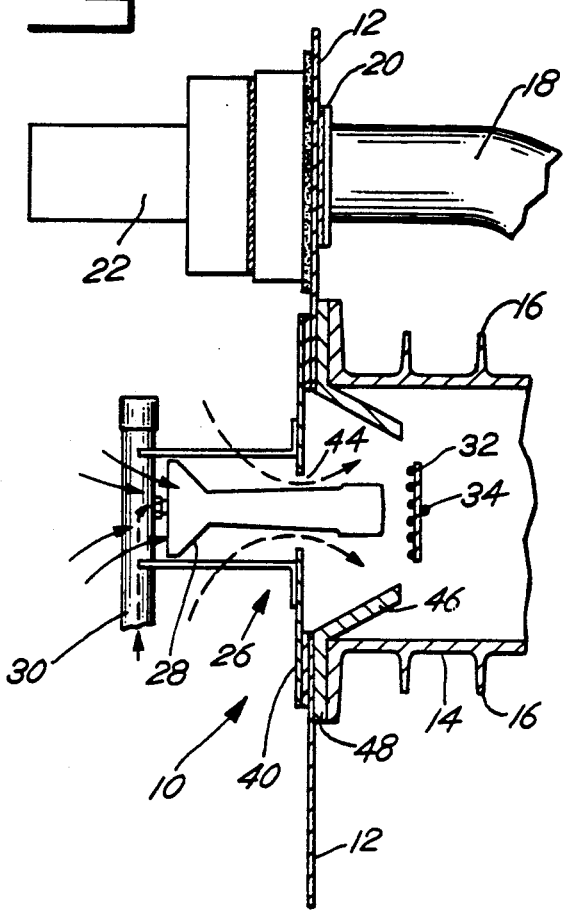
Fig. 2
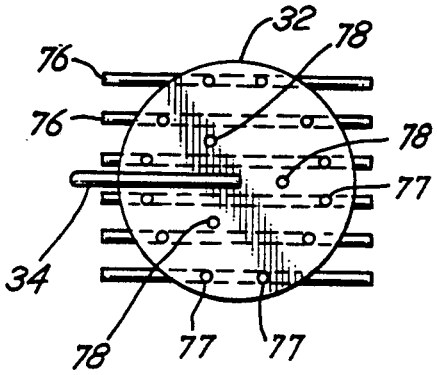
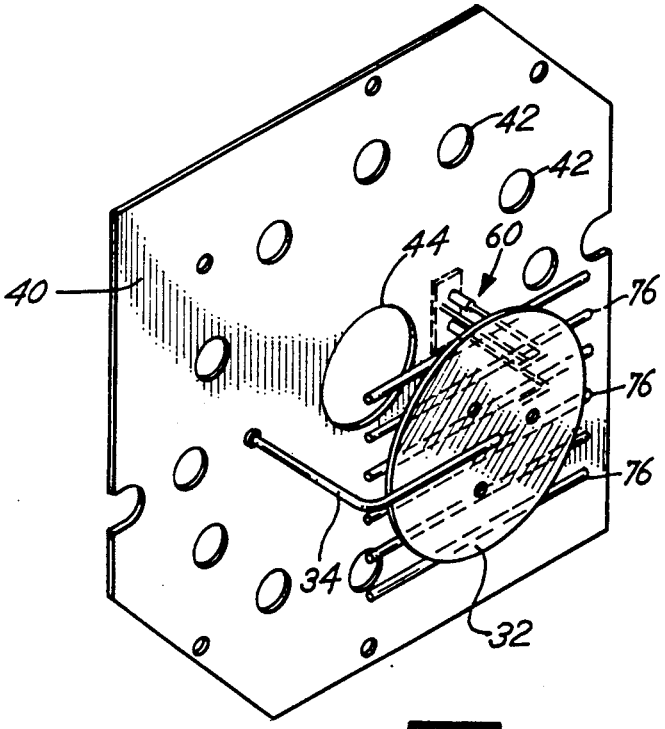
Fig. 3
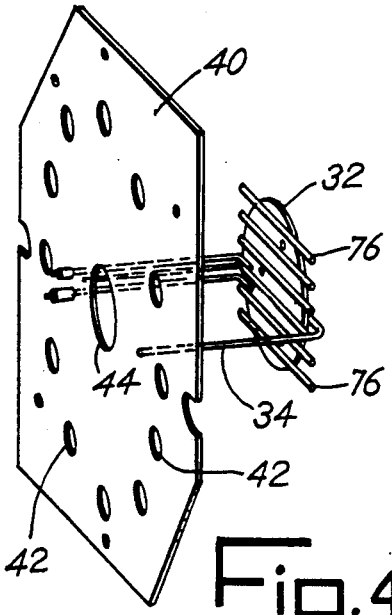
Fig. 4

$NO_x$ FLAME SPREADER FOR AN INSHOT BURNER

BACKGROUND OF THE INVENTION

This invention pertains to a furnace having a generally cylindrical combustion chamber with an improved single port inshot target burner, and more particularly to an $NO_x$ flame spreader for said inshot target burner.

The problem faced was the design of a burner capable of satisfactorily firing with reduced $NO_x$ emissions for furnaces having capacities in the range of 100,000 to 125,000 BTUs. For certain applications, there was a requirement that the $NO_x$ emissions from gas furnaces not exceed 40 nanograms per Joule (ng/J). It was found that the single port inshot target burner of Ser. No. 07/523,661, now U.S. Pat. No. 5,083,917 granted Jan. 28, 1992, performed satisfactorily for a number of applications but exceeded 40 ng/J for certain gas furnaces.

An object of the present invention is to provide a furnace utilizing an improved single port inshot target burner that includes a $NO_x$ flame spreader for overcoming the disadvantages and deficiencies of prior single port inshot target burners as above described.

Another object of this invention is to provide an improved single port inshot target burner having a $NO_x$ flame spreader for lowering the heat energy and temperature of the gas flame so as to avoid certain $NO_x$ emissions.

Still another object of this invention is to provide an improved single port inshot target burner having a plate with a plurality of rods fixed thereto for lowering the temperature of the gas flame so as to reduce $NO_x$ emissions.

Other objects and advantages of the present invention will be made more apparent hereinafter.

BRIEF DESCRIPTION OF THE DRAWINGS

There is shown the attached drawing a presently preferred embodiment of the present invention wherein like numerals in the various views refer to like elements and wherein:

FIG. 1 is a partial cross-sectional view of a furnace showing the arrangement of combustion chamber, single port inshot target burner, frustro-conical member, and induced air blower;

FIG. 2 is an end view of the $NO_x$ flame spreader;

FIG. 3 is a perspective view of the flame spreader affixed to the vestibule panel for the furnace; and FIG. 4 is a front perspective illustrating the mounting of the flame spreader on the vestibule panel;

DETAILED DESCRIPTION OF THE PRESENT INVENTION

The present invention represents an improvement in the single port inshot target burner of Ser. No. 07/523,661 filed May 15, 1990, now U.S. Pat. No. 5,083,917 granted Jan. 28, 1992. Reference may be made to said application Ser. No. 07/523,661 for details of the gas furnace with which the invention can be used. Briefly, as described in application Ser. No. 07/523,661, the combination heating-cooling unit includes an air conditioner and a furnace. The air conditioner incorporates a compressor, a condenser coil and an evaporator coil suitably interconnected in a refrigerant circuit and operated by known controls.

The furnace shown in application Ser. No. 07/523,661 includes a housing having a front wall or vestibule panel which supports the compact cylindrical combustion chamber and heat exchanger extending from an end of the combustion chamber. A blower is provided in the furnace for moving air to be conditioned through the combination heating-cooling unit. During cooling, air will flow from the area to be conditioned over the evaporator and back to area to be treated. The air conditioner is operative and the furnace is inoperative, hence the air will be cooled. During heating, air will be moved from the area to be treated over the heat exchanger and back to the area to be treated. The air conditioner is inoperative and the furnace is operative, hence the air will be heated. An induction fan is provided for drawing products of combustion from the heat exchanger and inducing a negative pressure within the combustion chamber.

With reference to FIGS. 1, 2 and 4, there is shown a portion of furnace 10 including front wall or vestibule panel 12 supporting combustion chamber 14. The combustion chamber 14 is a cast iron member having external fins 16 thereon. It is open at one end, as shown, and the other end communicates through an opening (not shown) with the heat exchanger 18, only a small portion of which is shown. Heat exchanger 18 communicates with plate 20, which is adapted to be affixed to the vestibule panel 12 in communication with the induction blower 22.

The single port inshot target burner 26 comprises an elongated housing 28 adapted to be connected to a fuel supply line 30 at one end and having a target plate 32 secured to an end of a rod 34 extending from the backup plate 40. The fuel may be natural gas or a like heating fuel such as propane.

Backup plate 40, which is affixed to the vestibule panel 12 by suitable fasteners, for example screws, has a plurality of air openings 42 and a central opening 44, which is spaced from the housing 28 of target burner 26. The openings 42 in plate 40 are arranged in a circular disposition about the central opening 44. Brackets connect the housing 28 to the backup plate 40 for securing the target burner 26 in position as shown in FIG. 1.

Primary air will be drawn into housing 28 where it is mixed with gas from the supply line 30. The air-gas mixture will be ignited and a flame will burn at the outlet end of the housing 28 of the target burner 26. The combustion process is enhanced by secondary air supplied through openings 42 in the backup plate 40 and through the space between the opening 44 in the backup plate 40 and the outside of the housing 28.

A frustro-conical member 46 is positioned concentric to the axis of housing 28 for directing secondary air toward the outlet end of the housing 28 and in the region between the outlet end of the housing 28 and target plate 32 to enhance the combustion process. The frustro-conical member 46 includes an annular flange 48 that is adapted to be clamped between the combustion chamber 14 and the vestibule plate 12. The member 46 is preferably fabricated from a ceramic fiber material, for example, PYROLITE. The member 46 is constructed and arranged to properly direct secondary air into the combustion zone. Also, it helps to reduce sound levels. In addition, the ceramic fiber material of member 48 has insulating qualities which allow the backup plate 40 and vestibule panel 12 to operate at lower temperatures than if they were in direct contact with the combustion chamber 14.

Referring to FIGS. 2 and 3, the target plate 32 is secured to a rod 34 that is secured at one end to the backup plate 40 and at the other end to the target burner 32. The rod 34 is generally L-shaped, with the long arm connected to the backup plate 40 and the short transverse arm connected to the target plate 32. Preferably, the rod 34 and target plate 32 are made from metal that will withstand the temperatures encountered in the combustion zone, e.g., stainless steel. The target plate 32 functions to improve flame retention and mixing. It is also used to shorten flame burnout, thus producing a more compact flame which will improve heat transfer to the walls of combustion chamber 14.

The ignition means 60 for igniting the target burner flame comprises an electrode 68 having spark ends 70, 71 located adjacent the outlet end of target burner 28 and between the outlet end and the target plate 32 for igniting the air-fuel mixture.

The flame should be basically blue with clear yellow streaking when properly adjusted for most efficient combustion. The secondary air will be directed by the frustro-conical member 46 into the combustion zone for maximizing the combustion process. The single port inshot target burner 26 cooperates with the combustion chamber 14 to provide an efficient utilization of fuel and maximum transfer of heat from the combustion chamber 14 to the heat exchanger 18.

The target plate 32 is provided with means for lowering the heat energy and temperature of the gas flame so as to lower the $NO_x$ emissions. Such means 74 provide substantial mass to absorb flame energy and comprise a plurality of rods 76 affixed to the face of the target plate 32 facing toward the housing 28. In one presently preferred form of the invention, there are 6 rods secured to the target plates 32. The rods 76 are fabricated of metal, preferably 304 stainless steel. Each rod has 3/16 inch outside diameter. The rods 76 are preferably arranged in parallel relationship to one another. The rods 76 are longer than the maximum dimension of the target plate 32, which in one form may be a circular plate about 3-½ inches in diameter made from 16 gauge stainless steel.

Preferably, the rods 76 are MIG welded to the target plate 32. In a preferred method, a plurality of holes 77 approximately one-quarter inch in diameter are formed in the target plate 32 along a circle. The holes are oriented such that the holes are disposed in rows of two, with the axes of each pair of holes being parallel. The rods 76 are positioned on the target plate 32 over the respective pairs of holes 77 and then MIG welded from the side opposite the sides against which the rods are positioned.

In addition to the holes 77 for aiding in securement of the rods 76 to the target plate 32, there are three additional holes 78 for assuring more complete combustion.

The industry standard formulation for determining emissions is as follows:

$$Ng/j = \frac{4.566 \times 10^4 \times P \times U}{HV \times CO_2 \times AFUE}$$

where

Ng=nanograms j=Joule $4.566 \times 10^4$=an emissions constant

P=particulate expressed as parts per million

U=ultimate $CO_2$ value for natural gas

HV=heating value or BTU content of natural gas $CO_2$=carbon dioxide

AFUE=annual fuel utilization efficiency

The present invention produces furnaces having capacities in the range of 100,000 to 125,000 BTUs capable of meeting the requirement of the South Coast Air Quality Management District that the $NO_x$ emissions from gas furnaces not exceed 40 ng/J. In preliminary testing of the noted gas furnaces, $NO_x$ emissions were reduced from 48 ng/J.

While I have shown and described a presently preferred embodiment of the invention, it is understood that the same is by way of illustration and example only and is not to be taken by way of limitation. The spirit and scope of the present invention are limited only by the terms of the appended claims and their proper equivalents.

I claim:

1. In a furnace having a cylindrical combustion chamber, a single port inshot target burner extending into said cylindrical combustion chamber, said target burner including an elongated housing, an inlet at one end and an outlet at the opposite end and a target plate secured adjacent the outlet, a gas flame being produced at the outlet during operation of the furnace, the improvement characterized by the target plate including means of substantial mass to absorb flame heat energy for lowering the heat energy and temperature of the gas flame so as to lower $NO_x$ emissions, (A furnace as in claim 1) wherein the means of substantial mass for lowering the heat energy and temperature of the gas flame includes a plurality of rods secured to the target plate.

2. A furnace as in claim 1 wherein the rods are approximately one-quarter inch in diameter.

3. A furnace as in claim 1 wherein the rods are affixed to the surface of the target plate facing the outlet from said housing.

4. A furnace as in claim 3 wherein six rods are secured to the target plate.

5. A furnace as in claim 4 wherein the rods are disposed in parallel relationship one to the other.

6. A furnace as in claim 3 wherein the rods are longer than the maximum dimension of the target plate.

7. A furnace as in claim 3 wherein the target plate is circular and the rods are longer than the diameter of the target plate.

8. A furnace as in claim 5 wherein the rods are uniformly spaced from one another.

* * * * *